US006334726B1

(12) United States Patent
Nakanishi

(10) Patent No.: US 6,334,726 B1
(45) **Date of Patent: *Jan. 1, 2002**

(54) PRINTING METHOD AND PRINTER WITH PLATEN

(75) Inventor: Kanji Nakanishi, Saitama (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/303,547

(22) Filed: May 3, 1999

(30) Foreign Application Priority Data

May 8, 1998 (JP) ..... 10-126369

(51) Int. Cl.[7] ..... B41J 11/02
(52) U.S. Cl. ..... 400/656; 400/648
(58) Field of Search ..... 400/656, 648, 400/662, 689, 655

(56) References Cited

U.S. PATENT DOCUMENTS

| | | | | | |
|---|---|---|---|---|---|
| 4,184,780 | A | * | 1/1980 | Kurihara et al. | 400/56 |
| 4,728,967 | A | * | 3/1988 | Tomita et al. | 346/136 |
| 5,593,236 | A | * | 1/1997 | Bobry | 400/88 |
| 5,672,017 | A | * | 9/1997 | Taniguchi | 400/120 |
| 5,673,078 | A | * | 9/1997 | Wen et al. | 347/220 |
| 5,816,724 | A | * | 10/1998 | Hada et al. | 400/656 |
| 5,887,992 | A | * | 3/1999 | Yamanashi | 400/88 |

* cited by examiner

*Primary Examiner*—John S. Hilten
*Assistant Examiner*—Darius N. Cone
(74) *Attorney, Agent, or Firm*—Sughrue Mion, PLLC

(57) ABSTRACT

A thermal printer has a thermal head for image recording to a thermosensitive recording sheet while applying pressure to the recording sheet. A plate-shaped platen supports the recording sheet during the pressure application of the thermal head to the recording sheet. The platen includes first, second and third plates serially laid on one another and secured to one another. The first plate is rigid. The second plate is resilient. The third plate has higher rigidity than the second plate, and has a smooth surface contacting the recording sheet.

24 Claims, 5 Drawing Sheets

PRINTING METHOD AND PRINTER WITH PLATEN

BACKGROUND OF THE INVENTION

1. Field of the Invention

The present invention relates to a printing method and a printer with a platen. More particularly, the present invention relates to a printing method and a printer with a platen, in which a thermal head can contact recording material in a reliably stable manner.

2. Description Related to the Prior Art

A thermal printer with type of a direct thermal recording is constituted by at least one platen roller for supporting thermosensitive recording material, and a thermal head including an array of plural heating elements. The recording material includes at least one thermosensitive coloring layer. The thermal head and the recording material are transported in a manner relative to one another, while the thermal head applies heat to the recording material to develop color on the recording material one line after another. There are various types of platen devices including the platen roller, which is constituted by a rubber roller member, and has a shape of a rod with a diameter of several centimeters.

According to the prior art, the platen roller is constituted by a rubber member, and becomes deformed according to a convexly curved surface of the heating element array of the thermal head. There is an area with high contact pressure in the vicinity of the central top of the heating element array of the thermal head. However areas distant from the central top of the heating element array have only small contact pressure. A problem exists in that an amount of conducted heat is likely to change due to changes in the contacting pressure. Coloring density is also changed due to changes in the amount of the conduced heat, to create irregularities in the density or color.

It is conceivable to increase hardness of the rubber material for the purpose of increasing pressure of the contact between the recording material and the thermal head. However another problem arises in that a depth of sinking of the heating element array into the recording material is decreased. The area of the contact is decreased, and also becomes subjected to the influence of changes in the pressure due to eccentricity of the platen roller and irregularities on its surface.

SUMMARY OF THE INVENTION

In view of the foregoing problems, an object of the present invention is to provide a printing method and a printer with a platen, in which a thermal head can contact recording material in a reliably stable manner.

In order to achieve the above and other objects and advantages of this invention, a printer includes a recording head for image recording to recording material in application of pressure to the recording material. A platen device supports the recording material during the pressure application of the recording head to the recording material, the platen device including first, second and third plates serially laid on one another and secured to one another, the first plate being rigid, the second plate being resilient, and the third plate having higher rigidity than the second plate, having a smooth surface, and contacting the recording material.

In a preferred embodiment, the printer is a thermal printer, the recording head is a thermal head for thermal recording by applying heat energy to the recording material.

Furthermore, the first plate is produced from metal, the second plate is produced from rubber, and the third plate is produced from resin.

The resin is polyethylene terephthalate.

Furthermore, a carriage transports the thermal head and the platen device relative to another thereof, wherein the thermal head affects the thermal recording during transportation of the carriage.

The thermal head includes one array of heating elements arranged in a main scan direction, and the carriage relatively transports the thermal head and the platen device in a sub scan direction crosswise to the main scan direction.

The carriage transports the thermal head.

In another preferred embodiment, the carriage transports the platen device.

Furthermore, there is a head support unit on which the thermal head is mounted. At least one guiding roller is secured to the head support unit, rotatable about an axis extending in the main scan direction, pressed against the recording material with the thermal head, for stabilizing orientation of the thermal head transported relative to the recording material.

At least one guiding roller comprises first and second guiding rollers disposed upstream and downstream from the thermal head with reference to the sub scan direction.

In another preferred embodiment, at least one guiding roller comprises first and second guiding rollers arranged in the main scan direction so that the thermal head is disposed therebetween.

The second plate is 0.5–10 mm thick, and the third plate is 0.05–0.5 mm thick.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1B:
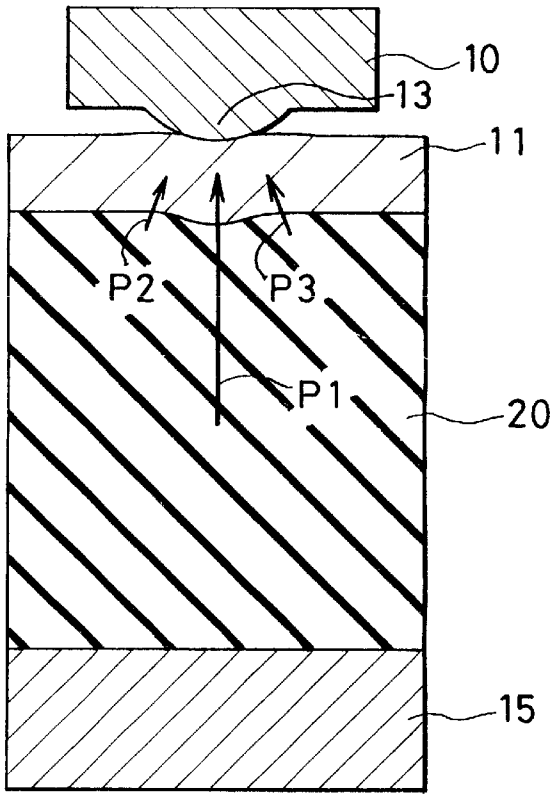
FIG. 1B is a section, partially broken, illustrating a platen according to a comparative example, together with the same as those of FIG. 1A.
Figure 1A:
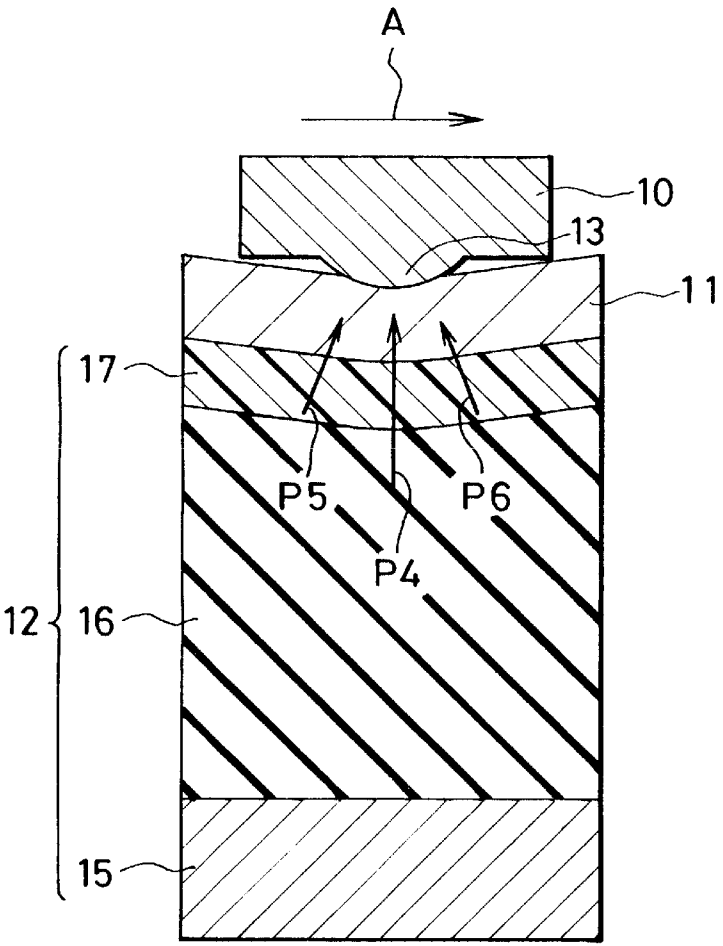
FIG. 1A is a section, partially broken, illustrating a platen of the present invention, together with a thermal head and a thermosensitive recording sheet.

In FIG. 1A, relative positions of a thermal head 10, a color thermosensitive recording sheet 11 and a plate-shaped platen 12 in a thermal printer are illustrated in accordance with the present invention. The thermal head 10 consists of a heating element array 13 having an arc shape as viewed in cross section as known in the art of thermal recording. The heating element array 13 is constituted by a head base plate, a partial glaze layer formed in the head base plate, heating elements or resistor elements arranged on the glaze layer, and a protection glass layer formed on the heating elements. The heating elements are arranged in line in a main scan direction, which is vertical to the surface of the drawing sheet.

The platen 12 is constituted by a laminated combination of a first plate 15, a second plate 16 and a third plate 17. The first plate 15 is produced from metal, and rigid. The second plate 16 is produced from synthetic rubber, and resilient. The third plate 17 is produced from polyethylene terephthalate (PET), and has a smooth surface and resiliency. The platen 12 has a shape of a rectangular quadrilateral, and has a size greater than the recording sheet 11. A thickness of the first plate 15 is predetermined to be suitable in consideration of the size of the recording sheet 11 so that the first plate 15 does not flex even when pushed upon by the thermal head 10 at the recording time. The second plate 16 is 2.5 mm thick. The third plate 17 is 0.2 mm thick. Note that the second plate 16 can have a thickness in a range of 0.5–10 mm, and in a preferable range of 2–3 mm. The third plate 17 can have a thickness in a range of 0.05–0.5 mm, and in a preferable range of 0.15–0.25 mm.

For the thermal recording, the recording sheet 11 is placed on the third plate 17. The heating element array 13 of the thermal head 10 is pressed against a recording surface of the recording sheet 11. The thermal head 10 is relatively transported in a sub scan direction indicated by the arrow "A" in a manner relative to the recording sheet 11. In synchronism with the relative transportation, each of the heating elements is driven to generate heat in accordance with image data.

In FIG. 1B, the recording sheet 11 is being subjected to thermal recording as directly placed on a rubber plate 20 included in a comparative platen. The recording sheet 11 and the rubber plate 20 are deformed by the convex face of the heating element array 13 of the thermal head 10. There is only a small area in which the heating element array 13 contacts the recording sheet 11. The heating element array 13 exerts pressing force in such a distribution that the pressure P1 at the center of the heating element array 13 is somewhat great, but that the pressure P2 and P3 in positions before and after the center of the heating element array 13 is remarkably smaller. An amount of conducted heat is likely to change due to changes in the pressure. Consequently it is impossible to apply heat energy to the recording sheet 11 with high precision in view of requirement for coloring. There occur irregularities in the density and colors.

In the present embodiment, the third plate 17 is disposed between the recording sheet 11 and the second plate 16 and has higher rigidity than the second plate 16. See FIG. 1A. Then the recovering force of the second plate 16 can operate in a comparatively large area by means of the third plate 17. Thus an enlarged area of the contact between the thermal head 10 and the recording sheet 11 is obtained. In addition of the increase in the central pressure P4, the pressure P5 and P6 can be increased in positions before and after the thermal head, due to the recovering force of the second plate 16 transmitted by the third plate 17. Influence due to the changes in the pressure is reduced in comparison with the comparative example in FIG. 1B. It is possible to prevent the occurrence of irregularity in the density due to changes in the pressure.

Figure 2:
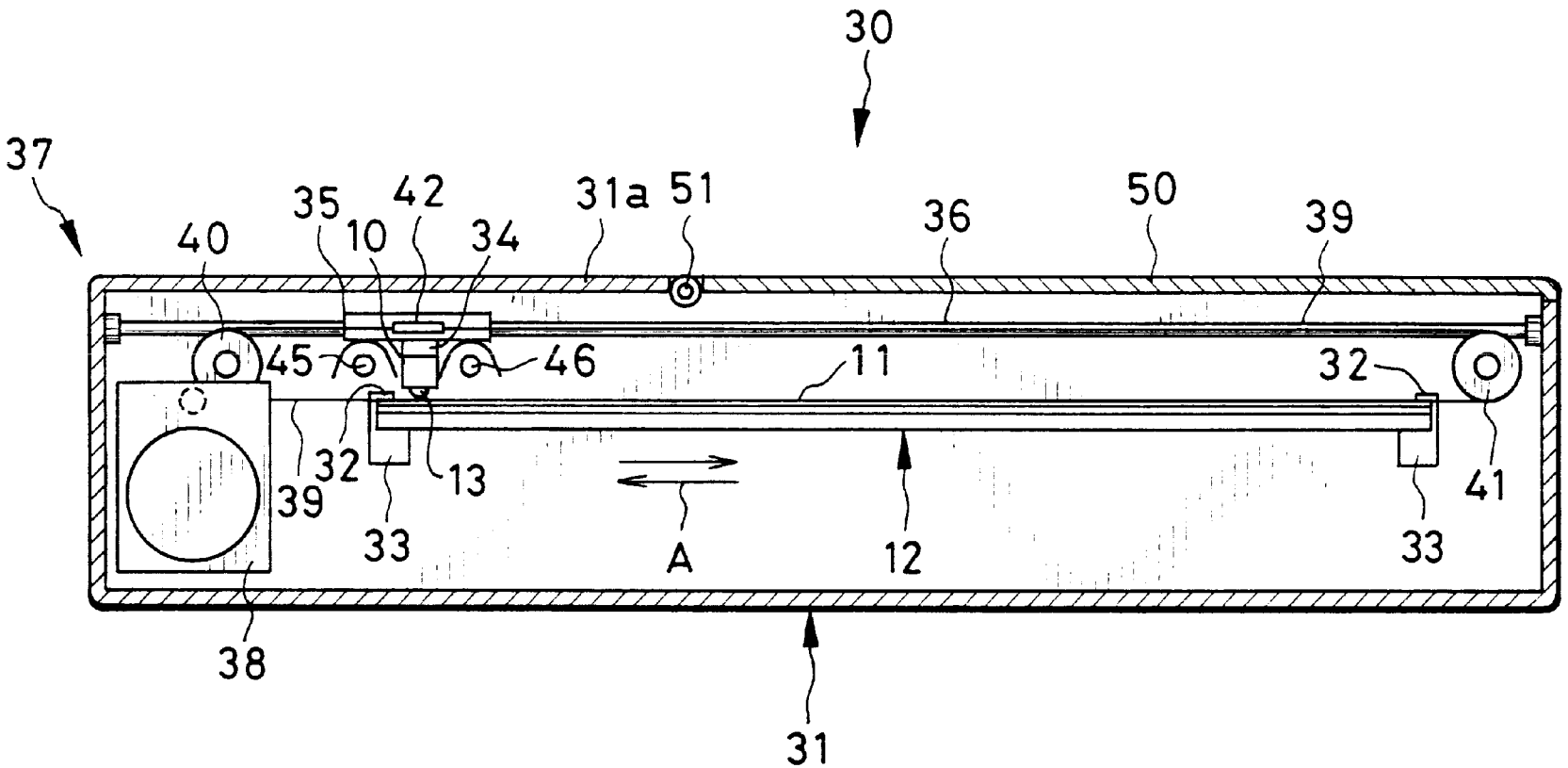
FIG. 2 is a vertical section illustrating a thermal printer of the present invention.

In FIG. 2, a color thermal printer 30 is generally depicted. A frame 31 is provided with the platen 12 supported stationary in relation to a horizontal direction. Clampers 32 are disposed on ends of the platen 12. A drive unit 33 shifts the dampers 32 up and down in the vertical direction between a clamping position and an open position. The clampers 32, when in the clamping position, clamp the recording sheet 11, and when in the open position, release the recording sheet 11 from clamping.

A sliding support 35 is disposed over the platen 12. A guiding rod 36 is so inserted through the platen 12 that the sliding support 35 is guided and kept slidable in the horizontal direction. A shifter mechanism 34 connects the thermal head 10 to the sliding support 35. The heating elements of the thermal head 10 are arranged in the main scan direction perpendicular to the guiding rod 36. The shifter mechanism 34 operates to shift the thermal head 10 between a recording position where the thermal head 10 presses the recording sheet 11, and a retracted position where the thermal head 10 is away from the recording sheet 11.

A head carriage 37 is connected to the sliding support 35, and includes a motor 38, an endless timing belt 39 and pulleys 40 and 41. The motor 38 is provided with a speed reducing mechanism. The endless timing belt 39 includes teeth. The pulleys 40 and 41 also include teeth, which are meshed with the endless timing belt 39 to circulate the same. A connector 42 connects one portion of the endless timing belt 39 fixedly to the sliding support 35. Thus rotation of the motor 38 in a forward or backward direction drives the endless timing belt 39, which in turn causes the sliding support 35 to slide in either direction along the guiding rod 36. Thus the thermal head 10 is transported in the sub scan direction A.

A yellow fixer lamp 45 and a magenta fixer lamp 46 are disposed to extend in parallel with the shape of the thermal head 10, and arranged adjacent to each other in the sub scan direction A. As is known in the art of the thermal recording, the fixer lamps 45 and 46 are driven to emit ultraviolet rays upon thermal recording of each of the three colors, to fix coloring layers optically immediately after the thermal recording. The coloring layers are kept from developing color further in the course of thermal recording of next color.

A top plate 31*a* of the frame 31 is provided with a movable lid 50, which is rotatable about an axis at a pivot 51, and supported in an openable manner. When the lid 50 is opened, a user manually sets the recording sheet 11 on the platen 12. There is a recording sheet sensor (not shown) disposed at an end of the platen 12. When the recording sheet 11 is set in a suitable position, the sheet sensor detects the recording sheet 11, so that the dampers 32 are controlled and shifted from the open position to the clamping position. Thus the recording sheet 11 is retained on the platen 12 in a fixed manner.

Each of the heating elements of the thermal head 10 is driven by a printing control unit (not shown) known to those skilled in the art, in synchronism with movement of the thermal head 10 in the sub scan direction A. The printing control unit operates for the driving in accordance with image data being input, so as to print yellow, magenta and cyan images to the thermosensitive coloring layers in accordance with the three-color frame-sequential recording.

The operation of the thermal printer 30 is described now. At first the lid 50 is opened. The recording sheet 11 is placed on the platen 12. While the lid 50 is open, the dampers 32 are kept in the open position. When the recording sheet 11 is positioned suitably, the sheet sensor detects the suitably positioned state of the recording sheet 11. The dampers 32 are shifted from the open position to the clamping position to retain the recording sheet 11 on the platen 12.

When a printing key in an operation panel (not shown) is operated, the thermal head 10 is transported in a forward direction toward the right, to record a yellow image line by line. The yellow fixer lamp 45 is driven to illuminate during the recording, to fix the yellow coloring layer after being heated. After the yellow recording, the yellow fixer lamp 45 is turned off. Then the thermal head 10 is moved in a backward direction toward the left, to record a magenta image line by line. The magenta fixer lamp 46 is driven to illuminate during the recording, to fix the magenta coloring layer after being heated. After the magenta recording, the magenta fixer lamp 46 is turned off.

The thermal head 10 is transported in the forward direction next, to record a cyan image. Also in the cyan recording, the magenta fixer lamp 46 is caused to illuminate and bleaches uncolored portions remaining besides colored portions. After the cyan recording, the thermal head 10 is shifted by the shifter mechanism from the recording position to the retracted position, and then is transported in the backward direction to a home position defined as an initial location of the thermal head 10. Then the lid 50 is opened to remove the recording sheet 11 after the recording.

In FIG. 1A, the recording sheet 11 is pressed against the heating element array 13 with the high pressure P4-P6 by the virtue of the recovering force of the second plate 16 through the third plate 17. The recording sheet 11 is received by the third plate 17 which has higher rigidity than the second plate 16. Thus there is little influence due to changes in the pressure, to suppress occurrence of irregularity in density.

In the above embodiment, the third plate 17 is produced from polyethylene terephthalate (PET). Furthermore, the third plate 17 can be produced from polyethylene naphthalate (PEN), polypropylene (PP), triaryl cyanurate (TAC), cellulose triacetate or any other suitable resin that has higher rigidity than the second plate 16.

Figure 3:
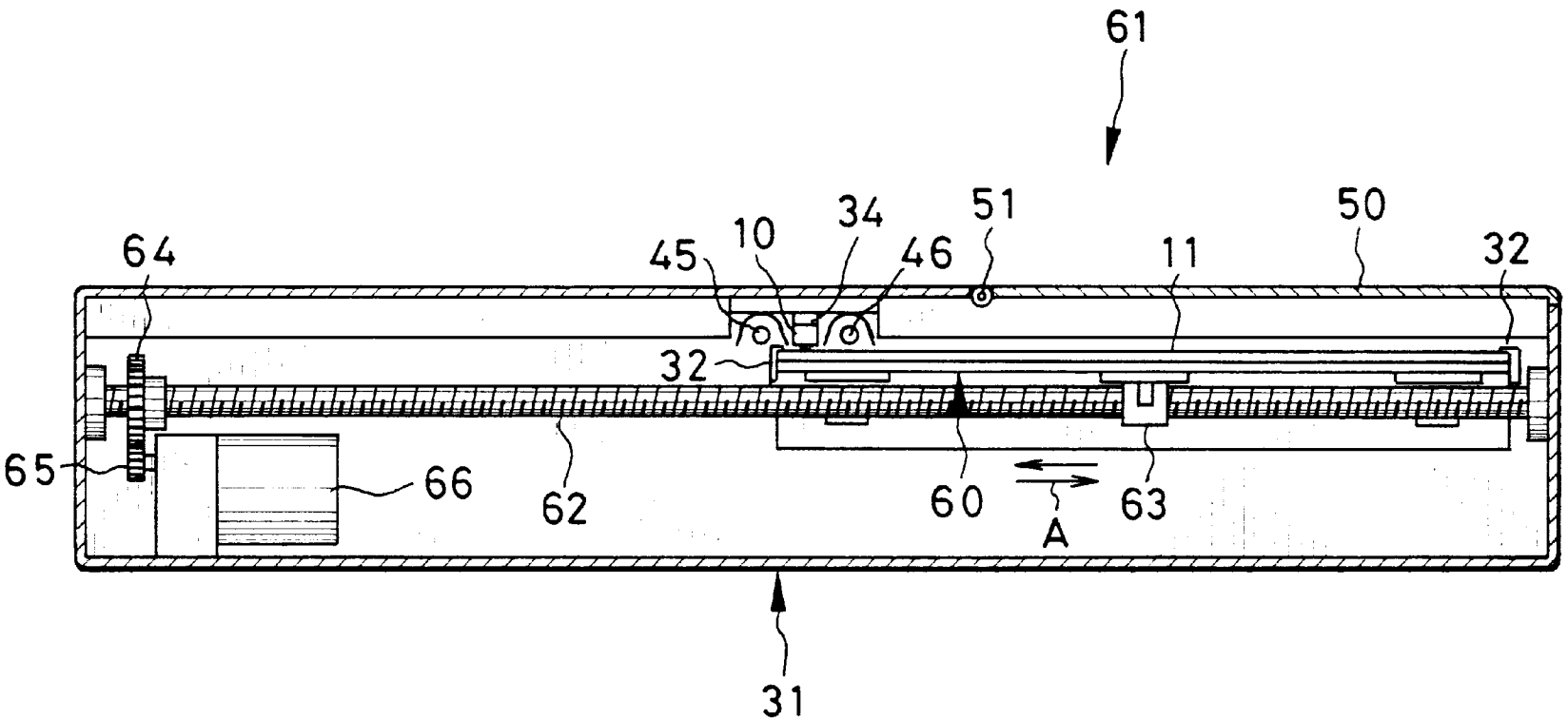
FIG. 3 is a vertical section illustrating another preferred thermal printer in which a platen plate is movable.

In the above embodiments, the thermal head 10 is transported back and forth. In contrast, a full-color thermal printer 61 as illustrated in FIG. 3 may include a plate-shaped platen 60 which may be movable back and forth for the three-color frame-sequential recording. A guiding rod (not shown) can be disposed to support the platen 60 in a slidable manner. A guiding screw 62 of a platen carriage is disposed along the guiding rod. A threaded member 63 with a female helicoid is meshed with the guiding screw 62, and is fixedly secured to the bottom surface of the platen 60. A motor 66 of the platen carriage is disposed, and causes the guiding screw 62 to rotate back and forth in engagement with gears 64 and 65. Elements similar to those in the embodiment of FIG. 2 are designated with identical reference numerals.

In the above embodiments, the yellow recording is during the forward transportation of the thermal head 10. The magenta recording is during the backward transportation of the thermal head 10. The cyan recording is during the forward transportation of the thermal head 10. Alternatively, three colors can be recorded during the transportation of the thermal head 10 in one common direction, either forward or backward. For this three-color recording, it is preferable to dispose the two fixer lamps in an upstream position with reference to the recording direction of the thermal head 10.

In the above embodiments, a user manually sets the recording sheet 11 on the platen 12, 60. Alternatively, a sheet supply mechanism (not shown) can be disposed for automatically supplying the platen 12, 60 with the recording sheet 11.

In the above embodiments, the dampers 32 are arranged on the ends of the platen 12, 60 in the sub scan direction A. Of course dampers may be arranged on ends of the platen 12, 60 with reference to the main scan direction for the purpose of retaining the recording sheet 11.

Figure 4:
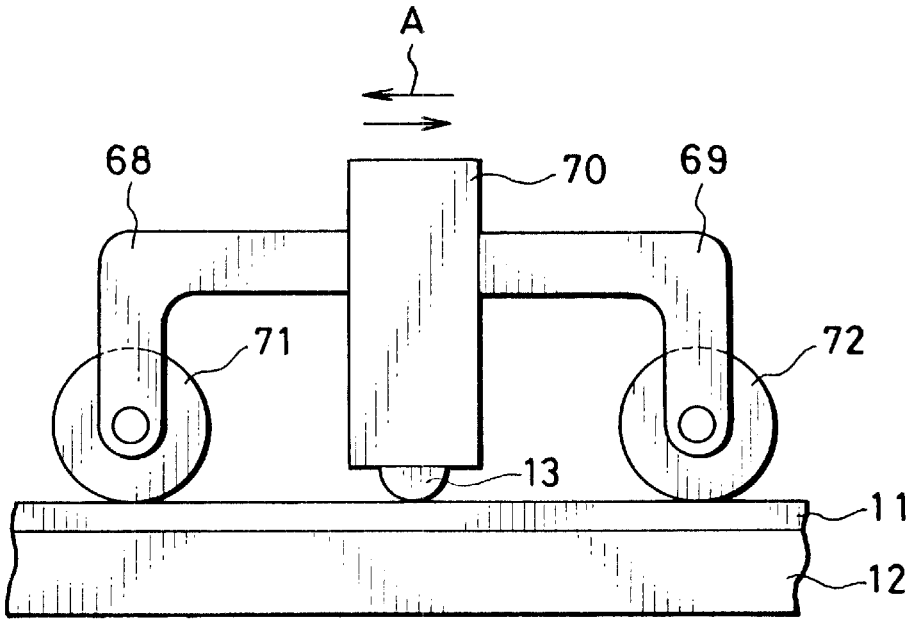
FIG. 4 is a side elevation illustrating another preferred embodiment in which guiding rollers are associated with a thermal head.
Figure 5:
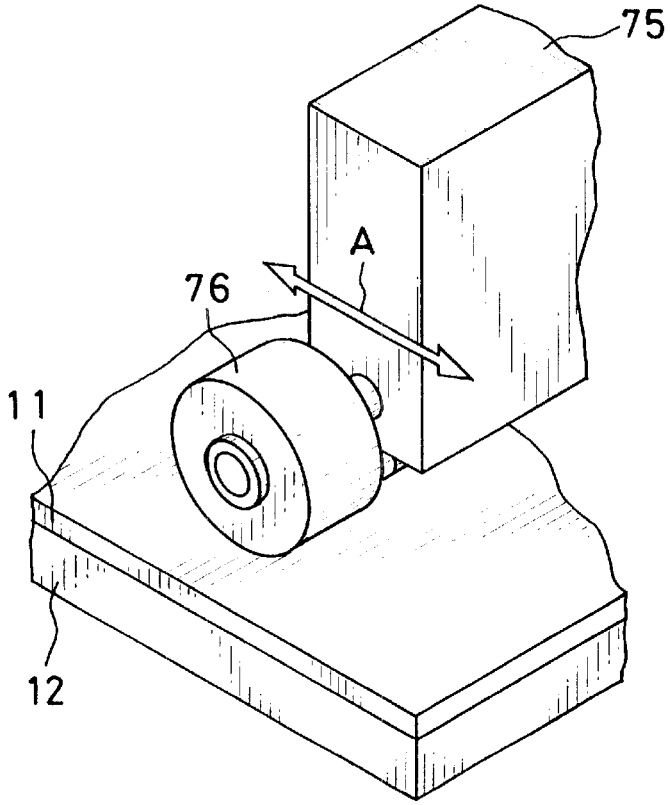
FIG. 5 is a perspective illustrating another preferred embodiment of a guiding roller with a thermal head.

In FIG. 4, a preferred embodiment is depicted, in which guiding rollers 71 and 72 are used with a thermal head 70. The guiding rollers 71 and 72 are disposed on respectively brackets 68 and 69 of a head support unit, and located beside the thermal head 70 in forward and backward directions with reference to the transportation of the thermal head 70. Furthermore in FIG. 5, a guiding roller 76 can be disposed in each of two lateral positions beside a thermal head 75. Also, an adjuster mechanism (not shown) may be disposed between the guiding roller 71, 72, 76 and the thermal head 70, 75, to adjust an amount by which the heating element array are sunken into the recording sheet.

Figure 6:
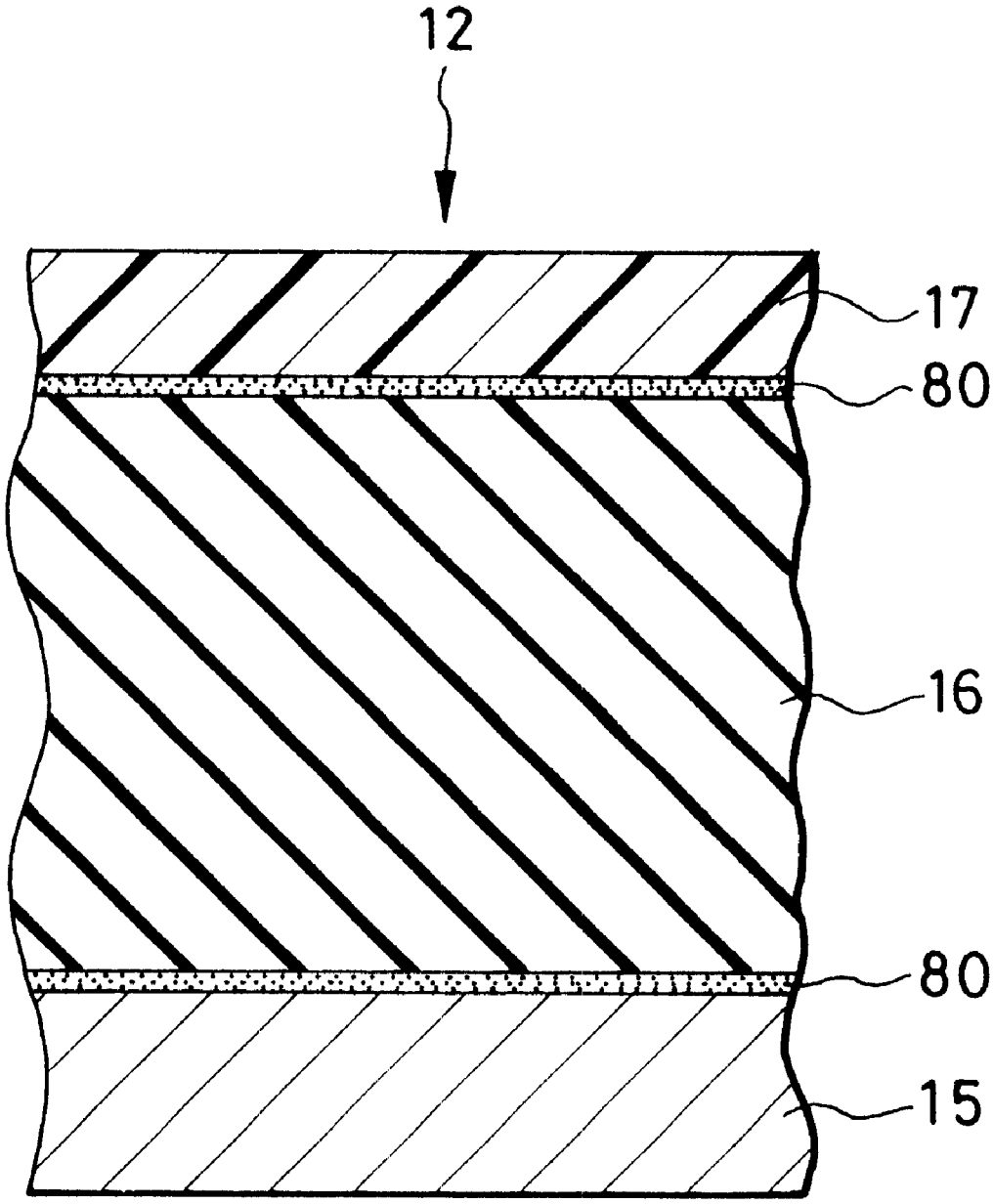
FIG. 6 is a section, partially broken, illustrating a structure of the platen.

In the above embodiments, the first plate 15, the second plate 16 and the third plate 17 are unified as the platen 12. To connect those with one another, various securing manners can be used. For example, adhesive agent 80 may be applied to surfaces of those plates 15–17 in contact with one another. See FIG. 6. Alternatively, end positions of those plates may be provided with through holes, and may be secured to one another by use of bolts and nuts.

It is to be noted that the plate-shaped platen 12, 60 is used in the thermal printer according to the above embodiments, but can be used in a telefacsimile machine, a printing press, a typewriter, or any machine for producing hard copies in any form.

Furthermore, the present invention may be used in a magnetic recording device for use with magnetic tape, disk, or other medium. A pad member for contacting the medium with a magnetic head can have a triple-layered structure.

The above platen 12, 60 is plate-shaped. However a platen in the present invention may be any of various known types, including a platen drum, a platen roller and the like.

In the above embodiments, the printer is a line printer of which the thermal head 10, 70, 75 is long in the main scan direction and transported in the sub scan direction A. However, the plate-shaped platen can be used in a serial printer in which the thermal head is transported in a twodimensional manner in the main and sub scan directions.

In the above embodiments, the recording sheets are color thermosensitive recording material. Furthermore, recording material in the present invention may be widely used simple paper called PPC paper, monochromatic thermosensitive recording material, thermosensitive ink film, photosensitive recording material, or the like.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A thermal printer comprising:

a platen for supporting said recording material, said platen including first, second and third members serially laid on one another and secured to one another, said first member being rigid, said second member being resilient, and said third member having higher rigidity than said second member, having a smooth surface, and contacting said recording material; and a thermal recording head for image recording to recording material by applying heat energy to said recording material while applying pressure to said recording material supported on said platen, wherein a recovering force of said second member to the applied pressure operates over a surface area larger than a contact area between said thermal recording head and the recording material, as the applied pressure is diffused by said third member into said second member.

2. A printer as defined in claim 1, wherein said second member is produced from rubber, and said third member is produced from resin.

3. A printer as defined in claim 2, wherein said resin is polyethylene terephthalate.

4. A printer as defined in claim 1, further comprising a carriage for transporting one of said thermal head and said platen relative to another thereof, wherein said thermal head effects said thermal recording during transportation of said carriage.

5. A printer as defined in claim 4, wherein said thermal head includes one array of heat elements arranged in a main scan direction, and said carriage transports in a sub scan direction crosswise to said main scan direction.

6. A printer as defined in claim 5, wherein said carriage transports said thermal head.

7. A printer as defined in claim 5, wherein said carriage transports said platen.

8. A printer as defined in claim 6, wherein said carriage includes at least one pair of guiding rollers, between which said thermal head is disposed, rotatable about an axis extending in said main scan direction, pressed against said recording material with said thermal head, for stabilizing orientation of said thermal head transported relative to said recording material.

9. A printer as defined in claim 2, wherein said second member is 0.5–10 mm thick, and said third member is 0.05–0.5 mm thick.

10. A thermal printing method which records information on a recording material placed between a thermal recording head and a platen, said platen comprising a rigid first plate, a second plate made of resilient material and secured to the first plate, and a third plate having higher rigidity than said second plate, having a smooth surface, and secured to the second plate, said printing method comprising the steps of:

placing the recording material against the third plate of the platen;

pressing the thermal recording head against the recording material;

enlarging a contact area between the thermal recording head and the recording material by diffusing a pressure force, of said pressing of the thermal head, transmitted into the second plate of the platen through the third plate; and applying heat energy to the recording material by selectively heating the thermal recording head.

11. A thermal printing method as defined in claim 10, wherein a recovering force of the second plate to the pressure force operates over a surface area larger than the contact area between the thermal recording head and the recording material.

12. A thermal printing method as defined in claim 10, wherein the second plate is produced from rubber, and the third plate is produced from resin.

13. A thermal printing method as defined in claim 12, wherein the first plate is produced from metal.

14. A thermal printing method as defined in claim 12, wherein said resin is formed of polyethylene terephthalate.

15. A thermal printing method as defined in claim 12, wherein said resin is selected from the group consisting of polyethylene naphthalate, polypropylene, triaryl cyanurate, and cellulose triacetate.

16. A thermal printing method as defined in claim 12, wherein said second plate is 0.5–10 mm thick, and said third plate is 0.05–0.5 mm.

17. A thermal printing method as defined in claim 14, wherein said second plate is 0.5–10 mm thick, and said third plate is 0.05–0.5 mm.

18. A thermal printing method as defined in claim 10, further comprising a step of transporting one of said thermal recording head and said platen relative to one another as the information is recorded onto said recording material.

19. A thermal printing method as defined in claim 18, wherein said thermal recording head includes one array of heating elements arranged in a main scan direction, and said thermal recording head and said platen are relatively transported in a sub scan direction substantially perpendicular to said main scan direction.

20. A thermal printing method as defined in claim 10, wherein the thermal recording head has a convex arc-shaped face that is pressed against the recording material.

21. A printer as defined in claim 1, wherein said thermal recording head has a convex arc-shaped face which is pressed against the recording material during image recording.

22. A printer as defined in claim 2, wherein said first member is produced from metal.

23. A printer as defined in claim 2, wherein said resin is selected from the group consisting of polyethylene naphthalate, polypropylene, triaryl cyanurate, and cellulose triacetate.

24. A printer as defined in claim 3, wherein said second member is 0.5–10 mm thick, and said third member is 0.05–0.5 mm thick.

* * * * *